US007878880B2

(12) United States Patent
Hendrickson

(10) Patent No.: US 7,878,880 B2
(45) Date of Patent: Feb. 1, 2011

(54) NURSING GARMENT

(75) Inventor: Lisa A. Hendrickson, Mount Laurel, NJ (US)

(73) Assignee: Destination Maternity Corporation, Philadelphia, PA (US)

( * ) Notice: Subject to any disclaimer, the term of this patent is extended or adjusted under 35 U.S.C. 154(b) by 422 days.

(21) Appl. No.: 12/108,858

(22) Filed: Apr. 24, 2008

(65) Prior Publication Data

US 2009/0265830 A1 Oct. 29, 2009

(51) Int. Cl.
*A41C 3/04* (2006.01)

(52) U.S. Cl. ..... 450/36; 450/58; 450/30; 2/104

(58) Field of Classification Search ..... 2/73, 2/114, 113, 115, 105, 106; 450/30–32, 53, 450/55–57, 36, 37, 3, 5, 7, 8, 10–13, 15, 450/16, 18, 20, 23
See application file for complete search history.

(56) References Cited

U.S. PATENT DOCUMENTS 4,494,388 A 1/1985 Lau et al.
5,149,336 A 9/1992 Clarke et al.
5,461,725 A 10/1995 Witczak
5,611,086 A * 3/1997 Eggen ..... 2/104
6,276,175 B1 8/2001 Browder, Jr.
6,839,908 B2 * 1/2005 Schneider et al. ..... 2/73
6,854,132 B1 * 2/2005 Polzin ..... 2/104
6,855,029 B2 * 2/2005 Rothman ..... 450/36
6,983,489 B2 * 1/2006 Caprio ..... 2/69
7,076,809 B2 * 7/2006 Rothman ..... 2/104
7,077,720 B2 * 7/2006 Schneider et al. ..... 450/36
7,396,272 B1 * 7/2008 Newlen ..... 450/54
7,448,090 B2 * 11/2008 Lucock ..... 2/104
7,488,234 B2 * 2/2009 Rothman et al. ..... 450/36
2001/0039672 A1 11/2001 Force
2005/0085160 A1 4/2005 Johnstone
2007/0271675 A1 11/2007 Eraca

OTHER PUBLICATIONS

International Search Report for PCT/US2009/041386 date Oct. 1, 2009.

* cited by examiner

*Primary Examiner*—Gloria Hale
(74) *Attorney, Agent, or Firm*—DLA Piper LLP (US)

(57) ABSTRACT

A nursing garment has an outer bodice adapted for pulling down to expose an inner bodice, wherein the inner bodice has respective breast-feeding openings. The outer bodice provides breast cups. The outer bodice provides a bra-like support. The inner bodice is stretchable to provide a bra-like support.

27 Claims, 10 Drawing Sheets

NURSING GARMENT

FIELD OF THE INVENTION

The present invention relates to a nursing garment, and more particularly to a nursing garment having a bodice construction adapted for nursing an infant.

BACKGROUND OF THE INVENTION

U.S. Pat. No. 6,854,132 discloses a nursing garment, including an outer garment and an inner garment. The inner garment includes two chest panels that overlap with one another. A nursing mother may raise the outer garment over her chest and pull either chest panel below her breast for breast-feeding an infant.

U.S. Pat. No. 5,461,725 discloses a garment featuring stretchable, resilient straps and a bodice. The straps are sufficiently resilient and suitably stretchable. Straps and bodice are resilient. The bodice has a resilient, stretchable bottom and a resilient, stretchable shirring on the front of the bust. The shoulder straps stretch when the bodice is pulled down to nurse an infant. The front shirring and the stretchable bottom cooperatively form a cup conforming to a breast of a wearer of the garment. A removable breast pad is attached on the inner surface of a cup using snap fasteners.

U.S. Pat. No. 6,983,489 discloses a nursing garment having breast retention panels constructed with two layers of fabric. An inner layer contains openings to insert breast pads. An outer layer provides an outer covering. The two layers are sewn together to form a pocket with an opening on the body side to provide access for receiving a pad.

U.S. Pat. No. 7,076,809 discloses a nursing garment having internal and external nursing flaps attached by respective fasteners to a shoulder strap. A built-in nursing bra is provided by internal sections comprising an elastic chest band, a soft cup frame, the internal nursing flaps, and a back piece of fabric. The internal fabric and flap can also have a pocket made of netting or made of fabric material to hold a nursing pad in place. The fasteners may include snaps, clasps or a hook and loop type fastener, in order to hold the internal and external fabric flaps, which cover the breasts and the soft cup frame.

U.S. Pat. No. 5,149,336 discloses disposable breast cups for a nursing and maternity bra. The breast cups comprise three layers, an inner fluid wicking layer, a central fluid layer and an outer moisture resistant layer.

SUMMARY OF THE INVENTION

According to the invention, a nursing garment has an outer bodice and an inner bodice, wherein the outer bodice is adapted for pulling down to expose the inner bodice. The inner bodice has breast feeding openings located for breast-feeding an infant. The outer bodice is adapted for pulling up to cover the inner bodice after nursing is completed.

The invention fulfills a need for a garment that is functional in terms of securing the bust area and having a nursing function, while providing modesty and an attractive appearance. Further, the invention provides a nursing garment, having soft breast cups as part of the bust area construction.

The present invention relates to a nursing garment covering at least a portion of the body between the shoulders and more or less to the waistline, with or without a collar and sleeves, worn inside or outside a lower garment including, but not limited to a skirt or slacks. The nursing garment according to the invention is adaptable in both knit and woven tops, in dresses, camisoles and sleepwear.

BRIEF DESCRIPTION OF THE DRAWINGS

Embodiments of the invention will now be described by way of example with reference to the accompanying drawings.

DETAILED DESCRIPTION

Figure 1:
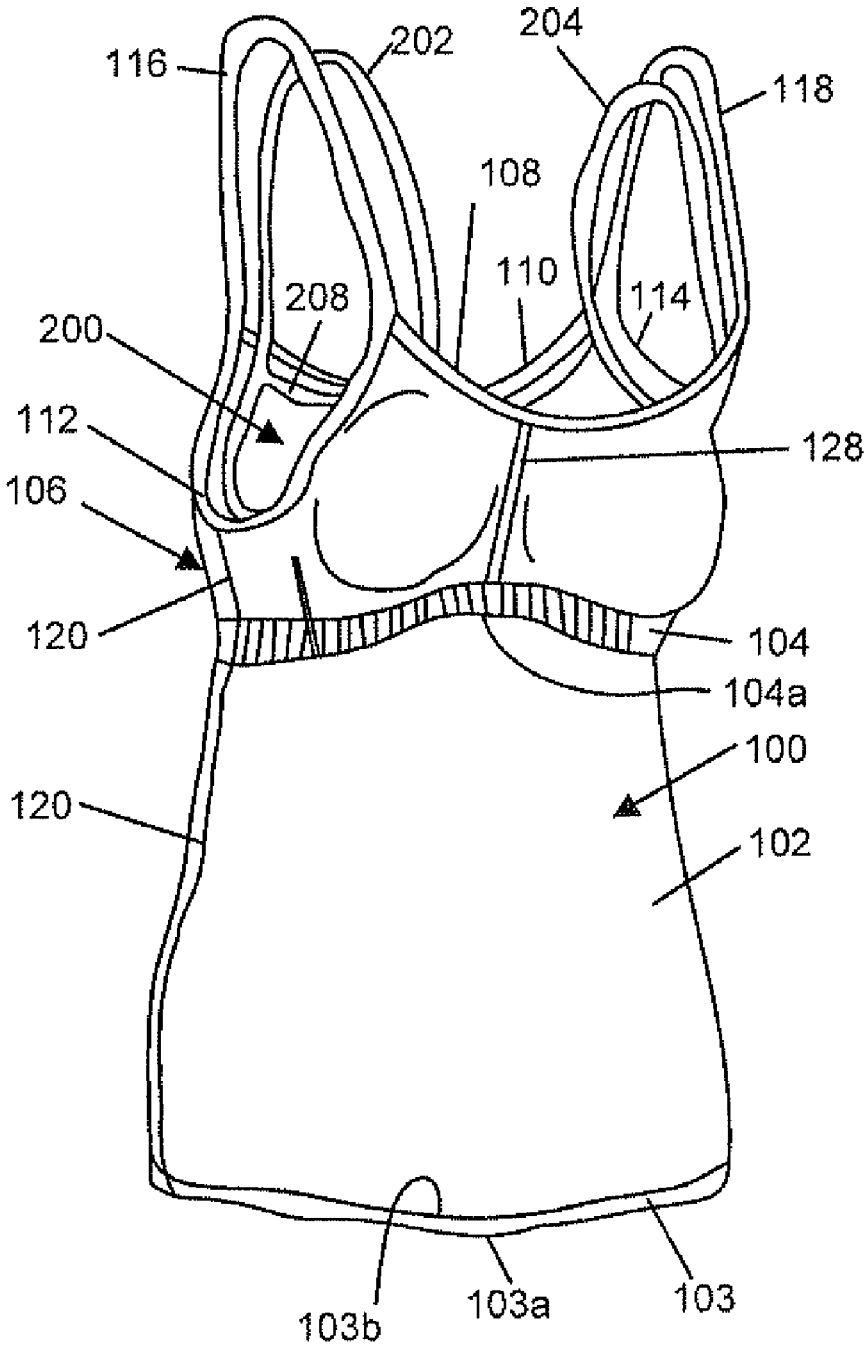
FIG. 1 is an isometric view of a nursing garment having an outer bodice and an inner bodice covered by the outer bodice.

FIG. 1 discloses a garment 100 for nursing or breast-feeding an infant. Further, the construction of the garment 100 varies according to various garment types, including but not limited to a camisole, sleepwear, garment top or a dress. FIG. 1 discloses a bottom portion 102 of the garment 100 that has a construction including, but not limited to a camisole, such that the construction of the bottom portion 102 varies according to the various garment types. Further, the garment 100 constructed for breast-feeding a nursing infant can be worn as a fashion top or layered under an outer garment top including, but limited to a shirt or blouse, sweater or jacket. Embodiments of the garment 100 provide a non-revealing, smooth outer appearance. According to an embodiment of the invention, the garment 100 provides a shelf bra to support a wearer's breasts.

As disclosed by FIG. 1, the bottom portion 102 extends downwardly from a chest band 104. Above the chest band 104, the garment 100 provides an outer bodice 106 and an inner bodice 200. The fabric of the outer bodice 106 is substantially continuous over the chest and is without openings to provide a smooth, one-piece appearance covering the breasts.

Preferably, the bottom portion 102 and the outer bodice 106 are united by being knitted or woven or seamed to provide a fashion garment 100 having a fashionable appearance, and which alternatively can be worn under an outer garment top including, but not limited to a shirt or blouse, sweater or jacket. Further, alternatively, the garment 100 is constructed as a one piece dress in which the bottom portion 102 is a skirt, and is knitted or woven or seamed with the outer bodice 106. Further, alternatively, the garment 100 is constructed as a one piece dress in which the bottom portion 102 is a skirt, and is knitted or woven or seamed with the inner bodice 108. The bottom portion 102 is open at the bottom. The bottom portion 102 has a bottom hem 103 knitted or woven with a turn back fold 103*a*, such that the bottom hem 103 is turned back inside the bottom portion 102. An edge of the bottom hem 103 is turned back, and is knitted or seamed with an anchoring edge stitch 103b to join the edge of the bottom hem 103 to the inside of the bottom portion 102.

The top of the outer bodice 106 has a front neckline 108 and a back neckline 110 and underarm sections 112 and 114, which are edge trimmed with a facing reinforcement, for example, a rolled-edge fabric or elastic reinforcement that reinforces an edge of the garment fabric while being comfortable to the touch against a wearer's skin. The back neckline 110 can project close to the neck of a wearer, or can project downward to provide a substantially backless appearance. The front neckline 108 and the back neckline 110 are attached to spaced apart shoulder straps 116, 118 for extending over respective shoulders of a wearer, to hold the garment 100 in place over the chest. The shoulder straps 116, 118 are sufficiently long for ease in removal from the shoulders of a wearer. The shoulder straps 116, 118 are edge trimmed with a facing reinforcement, for example, a rolled-edge fabric or elastic reinforcement that reinforces an edge of the garment fabric while being comfortable to the touch against a wearer's skin. For a cami style garment, the facing reinforcement can extend continuously along the shoulder strap 116 and a corresponding edge of an underarm section 112. Similarly, the facing reinforcement can extend continuously along the shoulder strap 118 and a corresponding edge of an underarm section 114 under an arm hole of the outer bodice 106.

The bottom portion 102 and the outer bodice 106 according to the invention are adaptable with a tubular, seamless knit fabric or a cut-and-sew woven fabric in patterned and cut sections that are sewn together along a side seam 120 under each of the underarm sections 112, 114. The fabric is a non-stretchable fabric or a resiliently stretchable and contractible material, woven or knitted with spandex or elastane fibers, such as LYCRA® fibers. The fabric is suitably soft to the touch and flexible to drape about a wearer's body. In an embodiment of the outer bodice 106, the fabric thereof is constructed of a stretchable fabric that can stretch for ease in removal from the shoulders of a wearer. For fabrication as a dress, the fabric of the outer bodice 106 extends along the shoulder straps 116, 118, and the fabric reinforcement that extends along the front neckline 108 and a back neckline 110 farther extends along the edges of the fabric of the shoulder straps 116, 118.

Preferably the chest band 104 is a resiliently stretchable and contractible elastic band, woven or knitted with spandex or elastane fibers, such as LYCRA® fibers. According to an embodiment of the invention, the chest band 104 laterally encircles at least part of the torso under the breasts of a wearer of the garment 100. Preferably the chest band 104 has a continuous circumference that completely encircles the torso of the wearer. The chest band 104 stretches to enlarge its circumference for a wearer to put on or remove the garment 100. While the garment 100 is worn, the chest band 104 conforms to the torso of wearer of the garment 100. The chest band 104 is a stretchable, torso encircling portion of the outer bodice 106 that stretches moderately while being worn to provide a bra-like support under the wearer's breasts.

Figure 1A:
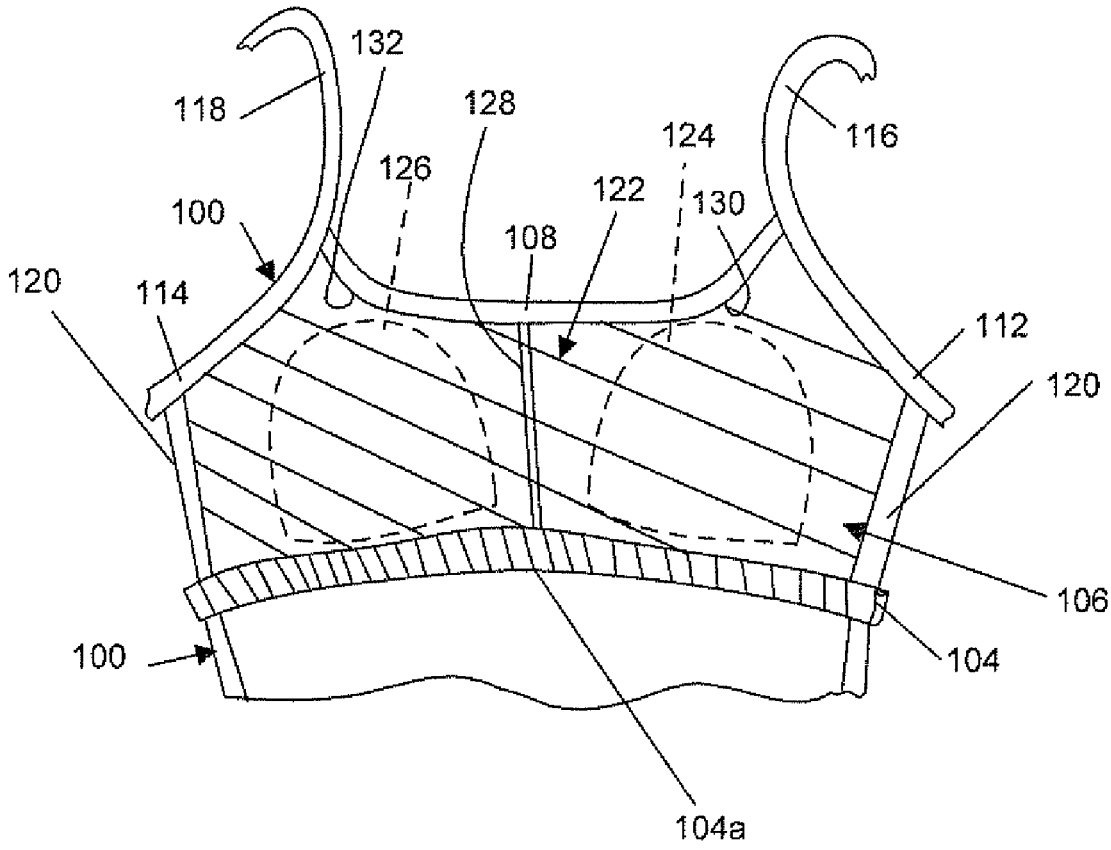
FIG. 1A is a fragmentary elevation view of an inner side or inside of the outer bodice of FIG. 1.

FIG. 1A discloses the inside of the outer bodice 106, which faces toward the wearer of the garment 100. An inner panel 122 provides a stretchable portion 122 of the outer bodice 106 indicated by diagonal lines. The inner panel 122 or lining is cut and sewn to extend vertically from the front neckline 108 to the chest band 104, and to extend laterally or horizontally from one side seam 120 to the other side seam 120. The inner panel 122 or lining is constructed of a stretchable fabric, knitted or woven. The stretchable fabric includes spandex or elastane fibers, such as LYCRA( fibers. The fabric of the inner panel 122 is stretchable to undergo elastically in two orthogonal directions, and is moderately stretched elastically while being worn to provide a bra-like support of the wearer's breasts.

The stretchable elastic inner bodice 200, the stretchable inner panel portion 122 of the outer bodice 106, a center front elastic band 128 and the stretchable elastic chest band 104 each provides a bra-like support of the wearer's breasts, and are referred to collectively as a shelf bra. Thus, the garment 100 is adapted for wearing without a separate bra.

FIG. 1A discloses a pair of soft padded breast cups 124, 126 between the outer bodice 106 and the inner panel 122 or lining. In an embodiment of the invention the inner panel 122 is sewn to the edge circumference of each of the breast cups 124, 126 that retain the cups 124, 126 and prevent the cups from shifting positions, especially while the garment is worn. Such a structure enables embodiments of the outer bodice in FIGS. 1C and 2B to be without a center front stitch to retain the cups 124, 126 and prevent the cups from shifting positions.

Figure 1B:
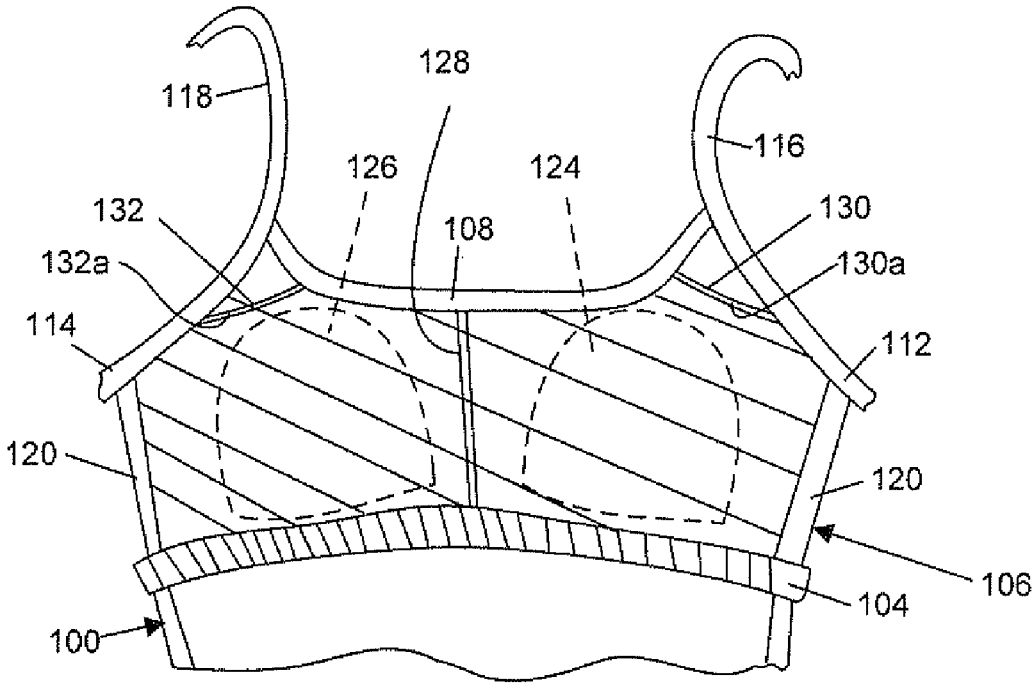
FIG. 1B is a view similar to FIG. 1A disclosing an alternative construction of the inner side or inside of the outer bodice.
Figure 1C:
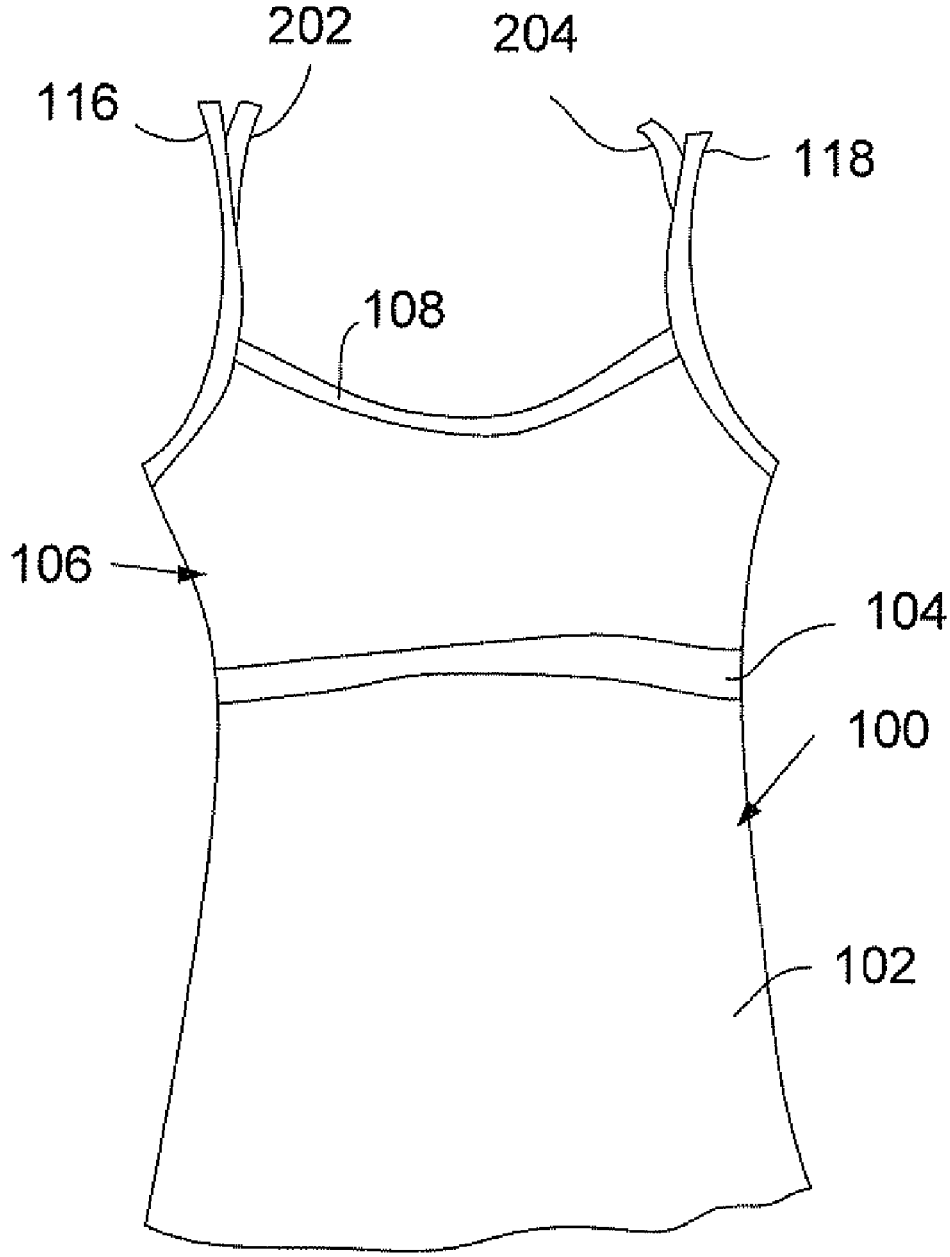
FIG. 1C is a fragmentary elevation view of another embodiment of a nursing garment.
Figure 1D:
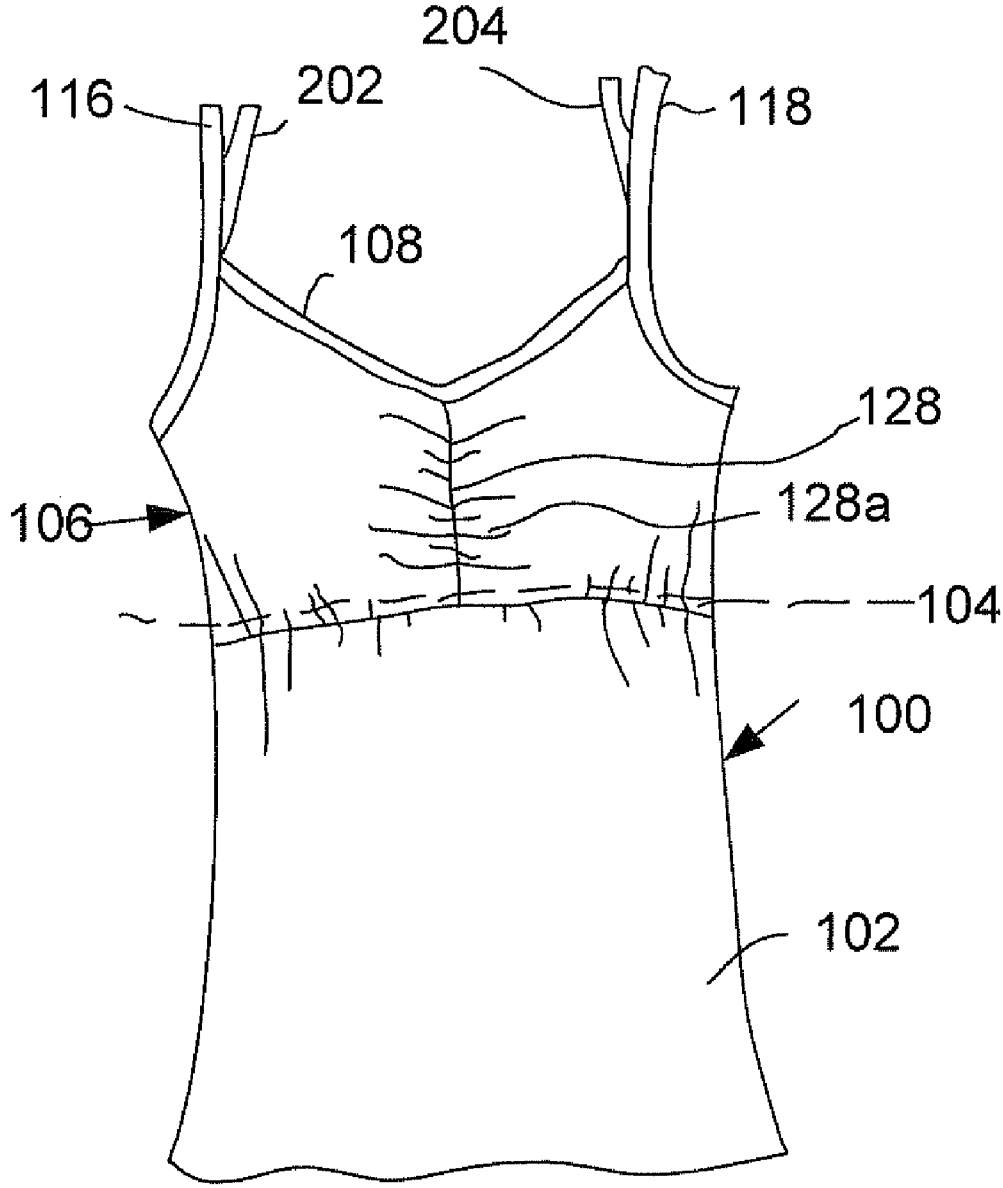
FIG. 1D is a fragmentary elevation view of another embodiment of a nursing garment.
Figure 2:
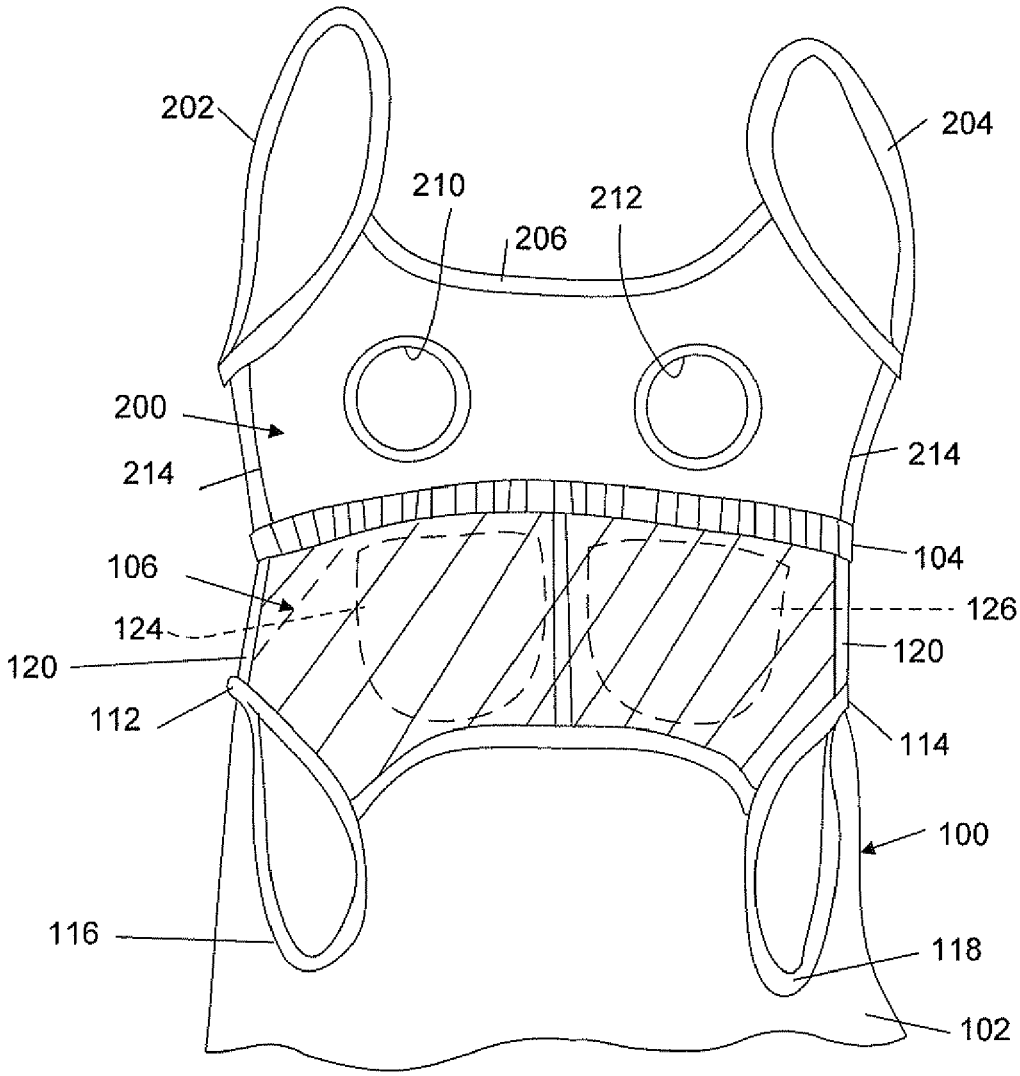
FIG. 2 is an elevation view disclosing an inner bodice uncovered by pulling down the outer bodice.

Each of FIGS. 1, 1A, 1B, 1D, 2, 2C and 2D discloses a corresponding embodiment of the garment 100 wherein a center front stitch 128 extending from near the front neckline 108 to near the chest band 104 sews the outer bodice 106 to the inner panel 122, as in FIG. 1A, 1B or 2, which partitions the inner panel 122 into cup receiving pockets 130, 132 that retain the cups 124, 126 and prevent the cups from shifting positions, especially while the garment is worn. An embodiment of a center front stitch 128 in FIG. 1D is formed by gathering the fabric of the elastic outer bodice 106 along a vertical, center front line and forming horizontal, random pleats 128*a*, then sewing the gathered fabric along the center front line. An embodiment of a center front stitch 128 in FIGS. 1, 1A, 1B and 2 is provided by an elastic band sewn to a non-pleated, smooth elastic outer bodice 106 covering the breast cups 124, 126. The knitted, center front stitch 128 is relatively narrow and extends vertically between the breast cups 124, 126 such that the center front stitch 128 extends vertically between the breasts of a wearer. An embodiment of the stitch 128 widens at the bottom thereof to provide widened support below the level of the wearer's breasts. Further, the center front stitch 128 restricts undesired lateral shifting of the outer bodice 106 when worn.

The cups 124, 126 are soft to the touch and are deformable against a wearer's anatomy to provide comfort while worn. The cups 124, 126 are retained in corresponding pockets 130, 132 without fasteners, which provides a smooth and modest appearance by conforming the fabric of the garment 100 to the smooth exterior contour of the cups 124, 126 in the absence of fasteners that would disrupt the contour.

In FIG. 1A the pockets 130, 132 are closed, such that the breast cups 124, 126 are not removable. In an alternative embodiment of FIG. 1B, the pockets 130, 132 have open tops 130*a*, 132*a* the edges of which are edge trimmed with a facing reinforcement, for example, a marrow stitch or a rolled-edge fabric reinforcement that reinforces an edge of the garment fabric while being comfortable to the touch against a wearer's skin. Each of the breast cups 124, 126 is retained in a corresponding pocket 130, 132 without being sewn. Each of the breast cups 124, 126 is removable from the corresponding pocket 130, 132 for separate laundering of the breast cups 124, 126 and the garment 100, and for replacement with other breast cups 124, 126. The breast cups 124, 126 are resiliently compacted to facilitate passage through the constricted open tops 130*a*, 132*a*. The pads resiliently expand within the pockets 130, 132. Alternatively, the open tops 130*a*, 132*a* can be sewn shut to retain the breast cups 124, 126 in the pockets 130, 132.

The breast cups 124, 126 cover the wearer's breasts to cover the anatomy and provide a non-revealing smooth profile covered by the outer bodice 106. In addition to providing a smooth and modest appearance, the breast cups 124, 126 are advantageously constructed of moisture absorbing material, and/or soft padding material. Further, each of the breast cups 124, 126 has a shaped interior contour to provide support for the breast, and to cover the breast for absorbency and modesty. Each of the breast cups 124, 126 has a shaped exterior contour providing a smooth and attractive outer appearance when covered by the inner bodice 200 and outer bodice 106.

Figure 2A:
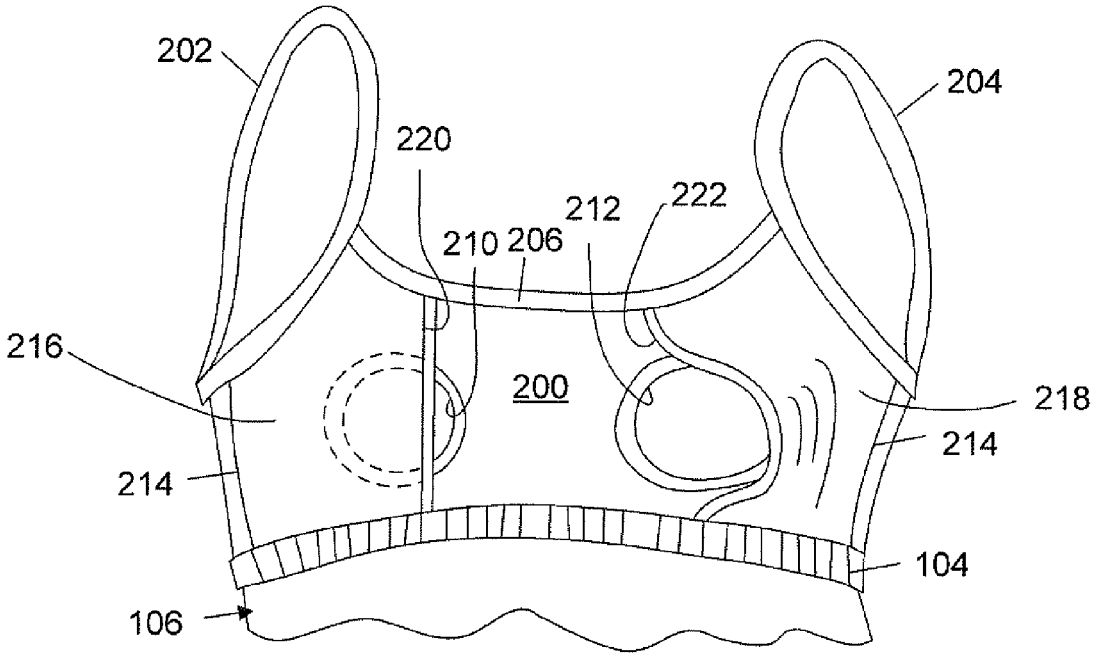
FIG. 2A is a fragmentary elevation view of an alternative embodiment of an inner bodice.

The breast cups 124, 126 are drawn against the wearer's breasts by the elastic resiliency of the stretchable inner panel 122 to augment the bra-like support provided by the outer bodice 106 and the chest band 104. Each of FIGS. 1C and 1D discloses an embodiment of the chest band 104 that extends approximately straight across the torso to position the bra-like support under the wearer's breasts. Each of FIGS. 1, 1A and 2D discloses a corresponding embodiment of the chest band 104 that rises upward to a peak 104*a* located at center front of the outer bodice 106 to position the bra-like support under the wearer's breasts. In the embodiment of FIG. 1, the peak 104*a* is a rounded peak. In the embodiment of FIG. 2D the peak 104*a* is a pointed peak.

A structural composition of the cups 124, 126 includes, but is not limited to natural fibers, feathers, down, polymeric fibers, polymeric foam or a combination thereof. Further the cups 124, 126 can be absorbent of fluid matter and washable in detergent. Alternatively, an anti-bacterial composition can be provided as an additive incorporated in or permeating the structural composition, or can be provided as an additive that is applied by being sprayed or coated on the structural composition.

In FIG. 1, the outer bodice 106 covers an inner bodice 200. In an embodiment of the invention disclosed by FIGS. 1, 1C, 1D and 2, the inner bodice 200 has corresponding shoulder straps 202, 204 for extending over respective shoulders of a wearer, to hold the inner bodice 200 in place over the chest.

The inner bodice 200 has a front neckline 206, FIG. 2, and a back neckline 208, FIG. 1, which are edge trimmed with a facing reinforcement, for example, a rolled-edge fabric reinforcement that reinforces an edge of the garment fabric and is comfortable to the touch when worn against a wearer's skin. The front neckline 206 of the inner bodice 200 is attached to the corresponding shoulder straps 202, 204 in the embodiment of FIG. 2, and similarly in the embodiments of FIGS. 1, 1C and 1D.

The inner bodice 200 is separate from the outer bodice 106 beginning at the chest band 104 and extending vertically throughout to the top necklines 108, 110, 206, 208. The inner bodice 200, the outer bodice 106 and the chest band 104 are sewn together at and along the chest band 104. According to an embodiment of the invention, at least a front of the inner bodice 200 is joined to the chest band 104. According to an embodiment, the inner bodice 200 has a circumference that completely encircles the garment 100 and the torso of the wearer, and is joined to the circumference of the chest band 104 that completely encircles the garment 100 and the torso of the wearer.

In an embodiment of the invention in each of FIGS. 1, 1C, 1D, 2, 2B, 2C and 2D the necklines 108, 110 of the outer bodice 106 are sufficiently wide to permit pulling an individual one, or both, of the straps 116, 118 off the wearer's shoulders in preparation for nursing an infant. An embodiment of stretchable fabric of the outer bodice 106 further permits pulling an individual one of the straps 116, 118 off the wearer's shoulders in preparation for nursing an infant. The soft and flexible garment material allows the outer bodice 106 to flex and facilitates removal from the shoulder and movement downward.

In FIG. 2, the inner bodice 200 has spaced apart, breast-feeding openings 210, 212 each knitted with, for example, a marrow stitch edge. The openings 210, 212 extend through the inner bodice 200, and are located to expose respective portions of the wearer's breasts for nursing an infant through the inner bodice 200, while wearing the inner bodice 200. Similar openings are provided in each embodiment of the inner bodice 200 of the garments 100 disclosed by FIGS. 1, 1C, 1D, 2B, 2C and 2D for nursing an infant through the inner bodice 200. FIG. 2 discloses that the shoulder straps 116, 118 of the outer bodice 106 are pulled off from corresponding shoulders of the wearer, and the outer bodice 106 is pulled down. The entire outer bodice 106 can be pulled down in preparation for nursing an infant, or alternatively, one side of the outer bodice 106 can be pulled down to expose a wearer's breast on one side in preparation for nursing. In preparation for nursing, to breast-feed an infant held in one of the arms of a wearer, the wearer reaches her hand of the other arm to remove only one of the shoulder straps 116, 118 of the outer bodice 106 from a corresponding shoulder of the wearer, and then the outer bodice 106 is adapted for pulling downward on one side thereof to uncover a portion of the inner bodice 200 and to uncover one of the wearer's breasts for nursing the infant at the breast on one side. During nursing, the inner bodice 200 is held up by the shoulder straps 202, 204. The inner bodice 200 is held down by the bottom garment portion 102. After nursing on the one side is completed, the outer bodice 106 is pulled up, and the corresponding one of the shoulder straps 116, 118 is pulled up and onto the wearer's shoulder.

In the embodiment of FIG. 2, the openings 210, 212 are uncovered in preparation for breast feeding by pulling down the outer bodice 106. In an alternative embodiment of FIG. 2A, each of the openings 210, 212 is covered at least partially by a corresponding curtain 216, 218, as shown by the curtain 216. Each curtain 216, 218 is sewn at the neckline 206, at the chest band 104, at a corresponding shoulder strap 202, 204 and at a corresponding side seam 214. Each curtain 216, 218 has an inward facing edge 220, 222, which is edge trimmed with a facing reinforcement, for example, a rolled-edge fabric reinforcement that reinforces an edge of the curtain fabric and is comfortable to the touch when worn against a wearer's skin. In preparation for nursing an infant on one side, the wearer of the garment 100 reaches with her hand to draw back a corresponding curtain 216, 218, as shown by the curtain 218 to uncover a corresponding opening 210, 212. After nursing on the one side is completed, the corresponding curtain 216, 218 resumes a prior position at least partially covering a breast, as shown by the curtain 216. After nursing is completed, the outer bodice 106 is pulled up. The breast cups 124, 126 are drawn against the curtains 216, 218 and the wearer's breasts by the elastic resiliency of the stretchable inner panel 122 to augment the bra-like support provided by the outer bodice 106 and the chest band 104.

Figure 2B:
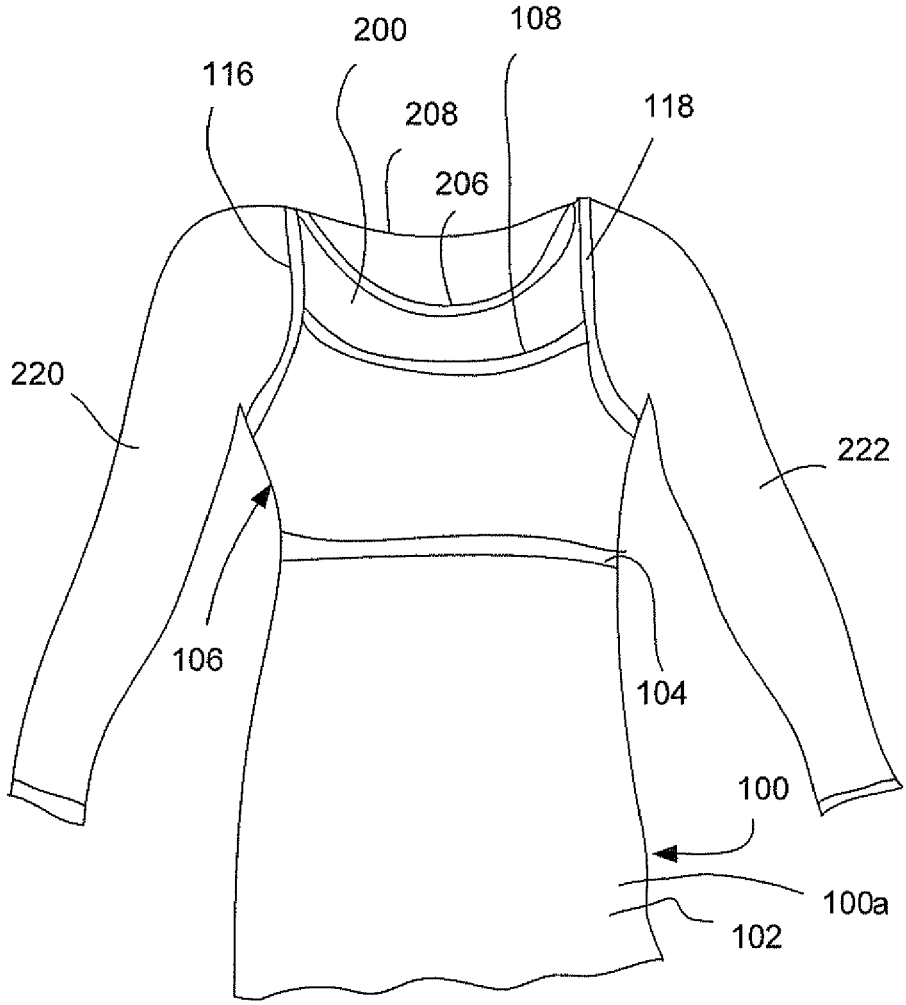
FIG. 2B is a fragmentary elevation view of an alternative embodiment of a nursing garment.
Figure 2C:
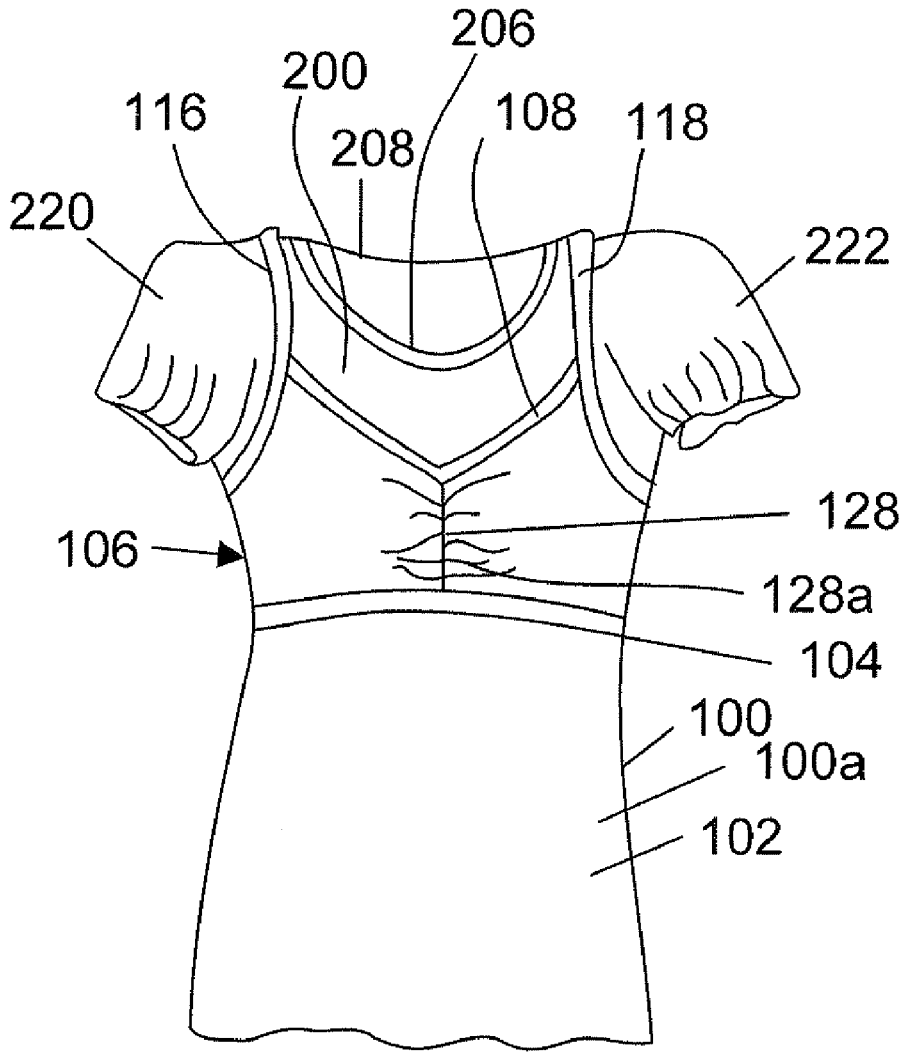
FIG. 2C is a fragmentary elevation view of an alternative embodiment of a nursing garment.
Figure 2D:
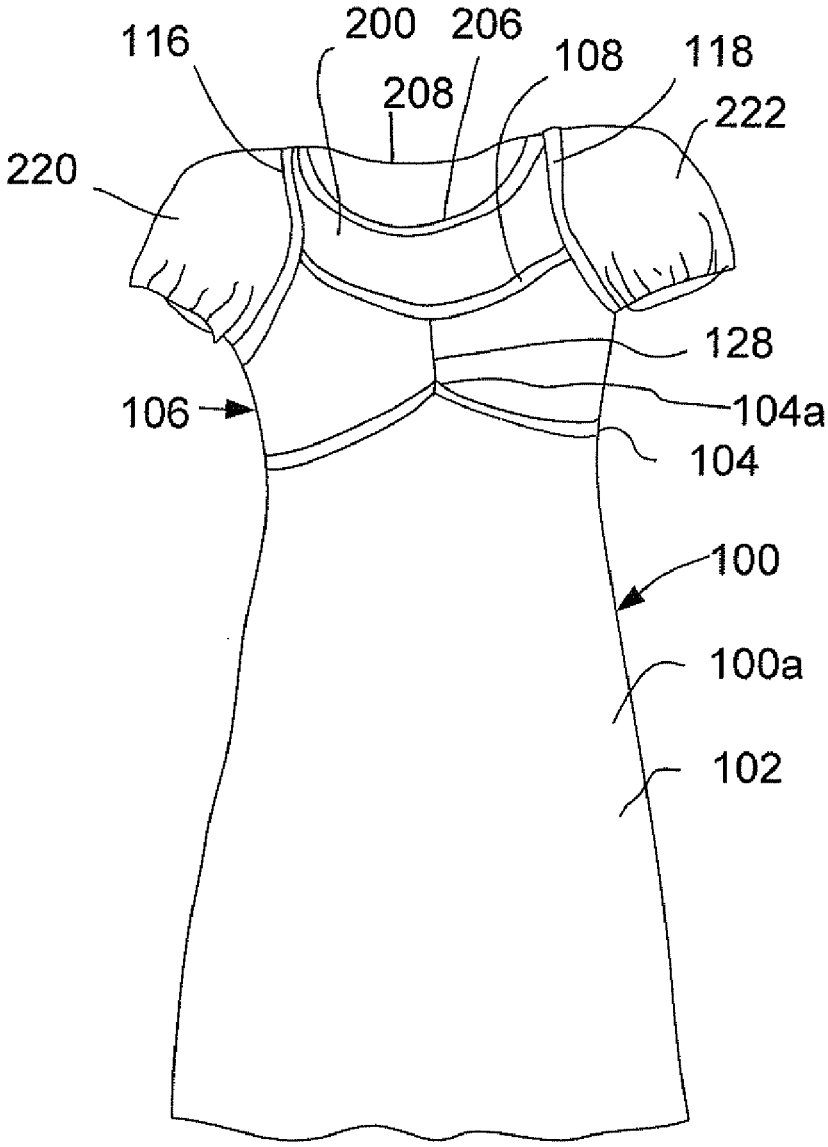
FIG. 2D is a fragmentary elevation view of an alternative embodiment of a nursing garment.

Each of FIGS. 2B, 2C and 2D discloses a corresponding embodiment of an outer garment 100*a* in the form of a dress, wherein the bottom garment portion 102 is a skirt knitted or woven or seamed, with both the outer bodice 106 and the inner bodice 200. The inner bodice 200 disclosed in each of FIGS. 2B, 2C and 2D extends above the neckline 108 of the outer bodice 106 and has sleeves 220, 222 to become a part of the outer garment 100. The inner bodice 200 has short sleeves 220, 222 in the embodiments disclosed by FIGS. 2C and 2D, or has long sleeves 220, 222 in the embodiment disclosed by FIG. 2B.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected," "sewn" and "interconnected," refer to a relationship wherein structures are secured or attached to one another either directly or indirectly through intervening structures, as well as both movable or rigid attachments or relationships, unless expressly described otherwise.

Patents and patent applications referred to herein are hereby incorporated by reference in their entireties. Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A nursing garment, comprising:

an outer bodice and an inner bodice, wherein the outer bodice is adapted for pulling down to expose the inner bodice and for pulling up to cover the inner bodice;

the inner bodice having respective breast-feeding openings and being adapted with curtains for drawing aside at the respective breast-feeding openings.

2. The nursing garment of claim 1 wherein the outer bodice provides breast support.

3. The nursing garment of claim 1 wherein a stretchable, torso encircling portion of the outer bodice provides breast support.

4. The nursing garment of claim 1 wherein a stretchable, torso encircling portion of the outer bodice provides breast support, and the torso encircling portion is a chest band.

5. The nursing garment of claim 1 wherein the inner bodice is stretchable to provide breast support.

6. The nursing garment of claim 1 wherein the outer bodice has a vertical center front elastic band providing breast support.

7. The nursing garment of claim 1 wherein the outer bodice has breast cups.

8. The nursing garment of claim 7 wherein the outer bodice provides breast support.

9. The nursing garment of claim 7 wherein a stretchable, torso . encircling portion of the outer bodice provides breast support.

10. The nursing garment of claim 7 wherein a stretchable, torso encircling portion of the outer bodice provides breast support, and the torso encircling portion is a chest band.

11. The nursing garment of claim 7 wherein the inner bodice is stretchable to provide breast support.

12. The nursing garment of claim 7 wherein the outer bodice has a vertical center front elastic band providing breast support.

13. The nursing garment of claim 7 wherein the outer bodice has respective pockets for receiving the respective breast cups.

14. The nursing garment of claim 7 wherein the outer bodice has respective pockets with open tops for receiving the respective breast cups.

15. The nursing garment of claim 7 wherein the breast cups are comprised of an antibacterial composition.

16. The nursing garment of claim 1 wherein the outer bodice has shoulder straps adapted for pulling down.

17. The nursing garment of claim 1 wherein the outer bodice has shoulder straps adapted for pulling down, and the inner bodice has corresponding shoulder straps to hold the inner bodice up while breast-feeding an infant.

18. The nursing garment of claim 1, comprising:

a chest band, wherein the outer bodice joins the inner bodice along the chest band.

19. A method of using the nursing garment of claim 1, comprising:

pulling down at least on one side of the outer bodice to uncover the breast-feeding openings through the inner bodice in preparation for breast-feeding; and pulling up the outer bodice to cover the inner bodice after completion of breast-feeding.

20. A nursing garment, comprising:

an outer bodice, the outer bodice having a front neckline, a back neckline, outer shoulder straps, and a chest band that encircles a torso of a wearer of the nursing garment;

and an inner bodice, the inner bodice having breast-feeding openings and inner shoulder straps, the inner shoulder straps separate from the outer shoulder straps;

wherein the outer bodice is adapted for pulling down to uncover the inner bodice and for pulling up to cover the inner bodice; and wherein the outer bodice and the inner bodice are separate garments sewn together at the chest band.

21. The nursing garment of claim 20, wherein one or more of the outer bodice and the inner bodice provide breast support.

22. The nursing garment of claim 20, wherein the outer bodice has breast cups.

23. The nursing garment of claim 22, wherein the outer bodice has respective pockets for receiving the respective breast cups.

24. A nursing garment, comprising:

an outer bodice, the outer bodice having a front neckline, a back neckline, and a chest band;

an inner layer;

a center front stitch that is vertically oriented from near the front neckline to near the chest band, wherein the center front stitch connects the outer bodice and the inner layer, and wherein the center front stitch partitions the inner panel into cup receiving pockets; and an inner bodice covered by the outer bodice, wherein the inner bodice is accessible by pulling down the outer bodice to expose the inner bodice, the inner bodice comprising breast-feeding openings.

25. The nursing garment of claim 24, further comprising breast cups that are retained in and removable from the cup receiving pockets.

26. The nursing garment of claim 24, wherein the center front stitch comprises a stretchable and contractible material.

27. The nursing garment of claim 24, wherein one or more of the outer bodice, the inner bodice, and the center front stitch provide breast support.

* * * * *